US011054123B2

(12) United States Patent
Sperling

(10) Patent No.: US 11,054,123 B2
(45) Date of Patent: Jul. 6, 2021

(54) ILLUMINATION SYSTEM WITH PIVOTABLE LIGHT EMITTING DIODE STRIP AND METHOD OF MANUFACTURE

(71) Applicant: Maxim Lighting International, Inc., City of Industry, CA (US)

(72) Inventor: Jacob Sperling, City of Industry, CA (US)

(73) Assignee: Maxim Lighting International, Inc., City of Industry, CA (US)

( * ) Notice: Subject to any disclaimer, the term of this patent is extended or adjusted under 35 U.S.C. 154(b) by 0 days.

(21) Appl. No.: 16/881,922

(22) Filed: May 22, 2020

(65) Prior Publication Data

US 2020/0309356 A1 Oct. 1, 2020

Related U.S. Application Data

(63) Continuation of application No. 15/411,755, filed on Jan. 20, 2017, now Pat. No. 10,663,152.

(51) Int. Cl.

| | |
|---|---|
| ***A47B 97/00*** | (2006.01) |
| ***F21V 21/30*** | (2006.01) |
| ***F21V 9/38*** | (2018.01) |
| ***F21V 15/01*** | (2006.01) |
| *F21V 23/06* | (2006.01) |
| *F21V 23/04* | (2006.01) |
| *F21Y 103/10* | (2016.01) |
| *F21Y 115/10* | (2016.01) |
| *F21V 23/00* | (2015.01) |

(52) U.S. Cl.

CPC ..... *F21V 21/30* (2013.01); *F21V 9/38* (2018.02); *F21V 15/01* (2013.01); *F21V 23/008* (2013.01); *F21V 23/04* (2013.01); *F21V 23/06* (2013.01); *F21Y 2103/10* (2016.08); *F21Y 2115/10* (2016.08)

(58) Field of Classification Search

CPC ..... F21V 21/30; F21V 23/06; F21V 15/01

See application file for complete search history.

(56) References Cited

U.S. PATENT DOCUMENTS 7,980,721 B2 * 7/2011 Gray ..... F21V 33/0012 362/133

9,310,037 B2 * 4/2016 Cercone ..... F21S 8/026

* cited by examiner

*Primary Examiner* — Andrew J Coughlin

(74) *Attorney, Agent, or Firm* — Polsinelli PC; Adam C. Rehm

(57) ABSTRACT

An illumination system having a plurality of housings pivotably or rotatably secured to each other, and capable of directing light in different directions when the plurality of housing are reconfigured relative to each other.

20 Claims, 4 Drawing Sheets

ILLUMINATION SYSTEM WITH PIVOTABLE LIGHT EMITTING DIODE STRIP AND METHOD OF MANUFACTURE

CROSS REFERENCE TO RELATED APPLICATIONS

This application is a continuation of U.S. patent application Ser. No. 15/411,755 filed Jan. 20, 2017 which is incorporated by reference in its entirety herein, and for all purposes.

BACKGROUND

1. Field

The present inventive concept relates generally to an illumination system, and more particularly, to an illumination system having a plurality of light emitting diodes positioned along a light emitting diode strip, configured to be secured to a mounting surface, and operable to illuminate a countertop surface area.

2. Description of Related Art

There are various types of conventional light devices that are currently available for use to illuminate an area. Such conventional light devices have limited functionality and, therefore, are only able to accommodate a limited number of lighting application requirements. Thus, there exists a need for an illumination system and a method of manufacturing an illumination system that does not suffer from the aforementioned deficiencies, is adaptable to accommodate a variety of different lighting application requirements, and is efficient, economical, and easy to manufacture and utilize.

SUMMARY

The present inventive concept provides an illumination system having a plurality of housings pivotably or rotatably secured to each other, and capable of directing light in different directions when the plurality of housings are reconfigured relative to each other when a user manipulates one of the plurality of housings.

The aforementioned may be achieved in one aspect of the present inventive concept by providing an illumination system. The illumination system may include a first housing. The first housing may include a first side wall, a second side wall, a rear wall, and/or a pair of end walls interconnecting the first side wall. The second side wall and the rear wall may define a first cavity. Each of the end walls may include an arm extending therefrom. The illumination system may include at least one electrical component housed at least partially within the first cavity. The illumination system may include a second housing pivotably secured to the first housing via the arms, and/or defining a second cavity. The illumination system may include an elongated illumination strip housed within the second cavity, in communication with the at least one electrical component, and/or operable to emit visible radiation or light in at least one direction.

The second housing may include a concave wall, end caps secured to either end of the concave wall, and/or an elongated lens spanning an opening defined by the concave wall and the end caps. The lens may be operable to allow the visible radiation or the light emitted from the illumination strip to be transmitted from the second housing in the at least one direction. The at least one electrical component may include electrical wiring with a female electrical connector extending through a first one of the sidewalls, and/or a male electrical connector extending through a second one of the sidewalls. The illumination strip may include a first row of light emitting diodes positioned equidistant to each other along the illumination strip, and/or a second row of light emitting diodes positioned equidistant to each other along the illumination strip.

The illumination system may include a three-way switch operable to cause the first row of light emitting diodes to be activated and the second row of light emitting diodes to be deactivated, the first row of light emitting diodes to be deactivated and the second row of light emitting diodes to be activated, and/or the first row of light emitting diodes and the second row of light emitting diodes to be activated. The illumination strip may include a printed circuit board, a set of light emitting diodes positioned along the printed circuit board, and/or a phosphor layer extending along the printed circuit board and substantially encompassing the set of light emitting diodes.

The illumination strip may include another set of light emitting diodes positioned along the printed circuit board, and/or another phosphor layer extending along the printed circuit board and substantially encompassing the another set of light emitting diodes. The phosphor layer and the another phosphor layer may have different concentrations of phosphor.

The first housing may include an access port defined by the first side wall, the second side wall, and/or the pair of end walls. The access port may be operable to be closed by a removable access panel. The opening and the access port may be planar and operable to rotate relative thereto so that the opening and the access port extend along a same plane relative to each other. The second housing may be operable to rotate relative to the first housing about an axis of rotation, and/or allow a user to selectively direct light emitted from the light strip in one of a plurality of directions relative to the first housing by rotating the second housing.

Each side of each of the end caps may be selectively concealable and exposable by a respective one of the arms when the second housing is rotated or pivoted relative to the first housing. The end caps may be substantially or entirely concealed by the arms when the second housing is positioned in a planar configuration. The end caps may be entirely or partially concealed and/or partially exposed by the arms when the second housing is positioned in a non-planar configuration via rotating or pivoting of the housings relative to each other.

The aforementioned may be achieved in another aspect of the present inventive concept by providing a method of manufacturing an illumination system. The method may include the step of forming a first housing. The first housing may have a first side wall, a second side wall, a rear wall, and/or a pair of end walls interconnecting the first side wall, the second side wall, and/or the rear wall. The first housing may define a first cavity. Each of the end walls may include an arm extending therefrom. The method may include the step of securing at least one electrical component at least partially within the first cavity. The method may include the step of pivotably or rotatably securing a second housing to the first housing via the arms. The second housing may define a second cavity. The method may include the step of securing an elongated illumination strip within the second cavity. The illumination strip may be in communication with the at least one electrical component, and/or operable to emit visible radiation or light in at least one direction.

The second housing may include a concave wall, end caps secured to either end of the concave wall, and/or an elongated lens spanning an opening defined by the concave wall and the end caps. The lens may be operable to allow the visible radiation or the light emitted from the illumination strip to be transmitted from the second housing in the at least one direction.

The illumination strip may include a first row of light emitting diodes positioned equidistant to each other along the illumination strip, and/or a second row of light emitting diodes positioned equidistant to each other along the illumination strip. The illumination strip may include a printed circuit board, a set of light emitting diodes positioned along the printed circuit board, and/or a phosphor layer extending along the printed circuit board and substantially encompassing the set of light emitting diodes. The illumination strip may include another set of light emitting diodes positioned along the printed circuit board, and/or another phosphor layer extending along the printed circuit board and substantially encompassing the another set of light emitting diodes. The phosphor layer and the another phosphor layer may have different concentrations of phosphor relative to each other.

The second housing may be operable to pivot or rotate relative to the first housing about an axis of rotation. The second housing may be operable to allow a user to selectively direct light emitted from the light strip in one of a plurality of directions relative to the first housing by pivoting or rotating the second housing. Each of the end caps may be substantially concealed by the arms when the second housing is positioned in a planar configuration relative to the first housing. The end caps may be entirely or partially concealed and/or partially exposed by the arms when the second housing is positioned in a non-planar configuration relative to the first housing.

Additional aspects, advantages, and utilities of the present inventive concept will be set forth, in part, in the description which follows and, in part, will be obvious from the description, or may be learned by practice of the present inventive concept.

The foregoing is intended to be illustrative and is not meant in a limiting sense. Many features and subcombinations of the present inventive concept may be made and will be readily evident upon a study of the following specification and accompanying drawings comprising a part thereof. These features and subcombinations may be employed without reference to other features and subcombinations.

BRIEF DESCRIPTION OF THE DRAWINGS

Embodiments of the present inventive concept are illustrated by way of example in which like reference numerals indicate similar elements and in which.

Figure 1:
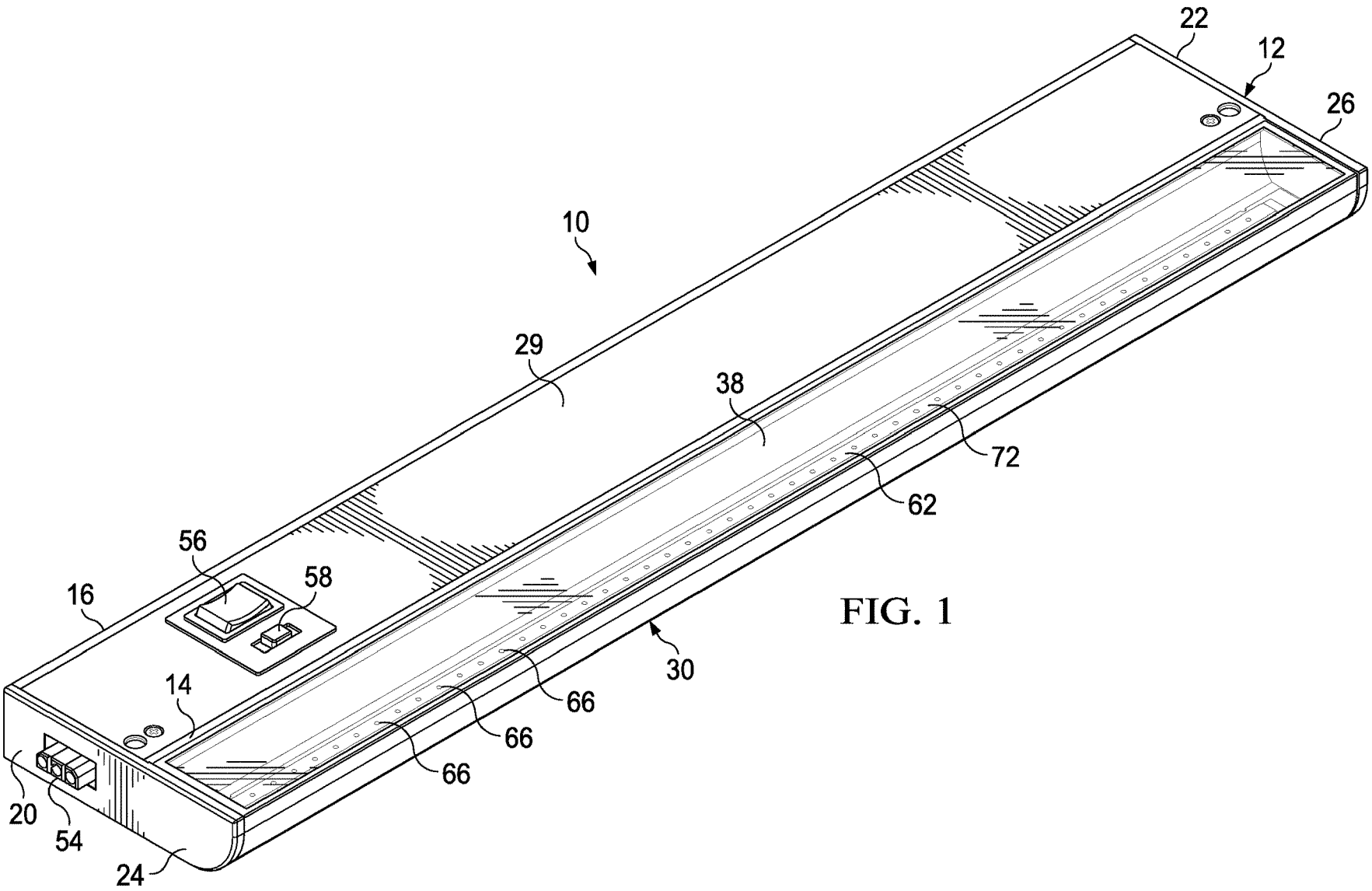
FIG. 1 illustrates a bottom, left side perspective view of an illumination system of the present inventive concept with a light emitting diode strip in a non-pivoted, planar configuration and a male electrical connector.

The drawing figures do not limit the present inventive concept to the specific embodiments disclosed and described herein. The drawings are not necessarily to scale, emphasis instead being placed on clearly illustrating principles of certain embodiments of the present inventive concept.

DETAILED DESCRIPTION

The following detailed description references the accompanying drawings that illustrate various embodiments of the present inventive concept. The illustrations and description are intended to describe aspects and embodiments of the present inventive concept in sufficient detail to enable those skilled in the art to practice the present inventive concept. Other components can be utilized and changes can be made without departing from the scope of the present inventive concept. The following description is, therefore, not to be taken in a limiting sense. The scope of the present inventive concept is defined only by the appended claims, along with the full scope of equivalents to which such claims are entitled.

I. Terminology

The phraseology and terminology employed herein are for the purpose of description and should not be regarded as limiting. For example, the use of a singular term, such as, "a" is not intended as limiting of the number of items. Also the use of relational terms such as, but not limited to, "top," "bottom," "left," "right," "upper," "lower," "down," "up," "side," are used in the description for clarity in specific reference to the figures and are not intended to limit the scope of the present inventive concept or the appended claims.

Further, any term of degree such as, but not limited to, "substantially" as used in the description and the appended claims should be understood to include an exact, or a similar, but not exact configuration. For example, "substantially annular" means having an exact annular shape or a similar, but not exact annular shape. Further, a "substantially planar" wall means having an exact planar surface or a similar, but not exact planar surface. Still further, "substantially C-shaped" means having an exact "C" shape or a similar, but not exact "C" shape. Also, a "substantially planar surface" means having an exact planar surface or a surface that is mostly planar, e.g., linear or straight. Similarly, a "substantially nonplanar surface" means having an exact nonplanar surface or a surface that is mostly nonplanar, e.g., curved.

Similarly, the terms "about" or "approximately" as used in the description and the appended claims should be understood to include the recited values or a value that is three times greater or one third of the recited values. For example, about 3 mm includes all values from 1 mm to 9 mm, and approximately 50 degrees includes all values from 16.6 degrees to 150 degrees.

Further, as the present inventive concept is susceptible to embodiments of many different forms, it is intended that the present disclosure be considered as an example of the principles of the present inventive concept and not intended to limit the present inventive concept to the specific embodiments shown and described. Any one of the features of the present inventive concept may be used separately or in combination with any other feature. References to terms "embodiment," "embodiments," and/or the like in the description mean that the feature and/or features being referred to are included in at least one aspect of the description. Separate references to terms "embodiment," "embodiments," and/or the like in the description do not necessarily refer to the same embodiment and are also not mutually exclusive unless so stated and/or except as will be readily apparent to those skilled in the art from the description. For example, a feature, structure, process, step, action, or the like described in one embodiment may also be included in other embodiments, but is not necessarily included. Thus, the present inventive concept may include a variety of combinations and/or integrations of the embodiments described herein. Additionally, all aspects of the present disclosure as described herein are not essential for its practice. Likewise, other systems, methods, features, and advantages of the present inventive concept will be or become apparent to one with skill in the art upon examination of the figures and the description. It is intended that all such additional systems, methods, features, and advantages be included within this description, be within the scope of the present inventive concept, and be encompassed by the claims.

Lastly, the terms "or" and "and/or" as used herein are to be interpreted as inclusive or meaning any one or any combination. Therefore, "A, B or C" or "A, B and/or C" mean "any of the following: A; B; C; A and B; A and C; B and C; A, B and C." An exception to this definition will occur only when a combination of elements, functions, steps or acts are in some way inherently mutually exclusive.

II. General Architecture

Turning to FIGS. 1-6, the present inventive concept provides an illumination system 10 operable to be securely affixed to and mounted on, e.g., via screws of the like, a generally planar mounting surface for use as an under-cabinet light fixture. It is foreseen, however, that the illumination system 10 could be mounted to any planar or non-planar surface and used in any manner without deviating from the scope of the present inventive concept.

The illumination system 10 includes a first housing 12 having a plurality of walls including a first side wall 14, a second side wall 16, a rear wall 18 extending between the first and second side walls 14, 16, and a pair of end walls 20, 22 interconnecting the first side wall 14, the second side wall 16, and the rear wall 18. In this manner, the walls 14, 16, 18, 20, 22 form a first cavity 23. In the exemplary embodiment, the first and second side walls 14, 16 extend parallel to each other, and the pair of end walls 20, 22 extend parallel to each other and perpendicular to the first and second side walls 14, 16. Thus, the first housing 12 is generally rectangular. It is foreseen, however, that the first housing 12 can be of any shape, e.g., oval, square, rectangular, triangular, or a combination thereof, without deviating from the scope of the present inventive concept. In the exemplary embodiment, the walls 14, 16, 18 of the first housing 12 are made of extruded aluminum, but it is foreseen that the walls 14, 16, 18 of the first housing 12 may be made of one or more other materials, e.g., plastic, without deviating from the scope of the present inventive concept. In the exemplary embodiment, the end walls 20, 22 of the first housing 12 are made of high-impact plastic, but it is foreseen that the end walls 20, 22 of the first housing 12 may be made of one or more other materials, e.g., aluminum, without deviating from the scope of the present inventive concept.

Each of the end walls 20, 22 include an arm 24, 26 respectively extending therefrom. Perimeter edges of each of the walls 14, 16, 20, 22 collectively define an access port 28 to the first cavity 23, which is closed by an access port cover 29. The cover 29 is removably secured to the first housing 12 via a plurality of screws, but it is foreseen that other attachment mechanisms, e.g., adhesive, friction fit, and/or loop-and-hook fasteners, may be used without deviating from the scope of the present inventive concept. In the exemplary embodiment, the cover 29 is made of extruded aluminum, but it is foreseen that cover 29 may be made of one or more other materials, e.g., plastic, without deviating from the scope of the present inventive concept.

The illumination system 10 further includes a second housing 30 having a plurality of walls including a generally "C" shaped concave wall 32 and a pair of end walls or end caps 34, 36. A respective one of the end caps 34, 36 is positioned at each end of the concave wall 32. In this manner, the concave wall 32 and the end caps 34, 36 form a second cavity 37. In the exemplary embodiment, the pair of end caps 34, 36 extend parallel to each other and perpendicular to the concave wall 32. Thus, the second housing 30 is generally rectangular. It is foreseen, however, that the second housing 30 can be of any shape, e.g., oval, square, rectangular, triangular, or a combination thereof, without deviating from the scope of the present inventive concept.

Perimeter edges of each of the concave wall 32 and the end caps 34, 36 collectively define an opening 40 to the second cavity 37, which is closed by a transparent or translucent lens 38. The lens 38 is secured to the second housing 30 during assembly of the end caps 34, 36 onto the concave wall 32 and is snugly secured therebetween, but it is foreseen that other attachment mechanisms, e.g., adhesive, friction fit, and/or hook-and-loop fasteners, may be used without deviating from the scope of the present inventive concept.

The second housing 30 is rotatably secured to the first housing 12 and between the arms 24, 26 via an attachment means such as pins or the like. The second housing 30 is operable to be selectively pivoted, swiveled, or rotated relative to the first housing 12 about an axis of rotation defined by a pin 42 or the like. The axis of rotation extends between and is generally located between the pin 42 on the arm 24 and another pin identically positioned on the arm 26, and along the arms 24, 26. For purposes herein, the terms "pivot," "rotate," and "pivot" are used synonymously to describe the movement of the second housing 30 relative to the first housing 12.

The first housing 12 includes a plurality of electrical components housed either entirely or partially therein. The plurality of electrical components includes conductive wiring 50 operable to provide power to the illumination system 10 and/or control the illumination system 10. In the exemplary embodiment, the illumination system 10 is wired for 120V operation using AC electrical power. However, wiring for other types of operation is possible, e.g., DC electrical power. The wiring 50 extends between some of the plurality of electrical components including a female connector 52 and a male electrical connector 54. Each one of the connectors 52, 54 is securely positioned on and extends through a respective one of the end walls 20, 22. In this manner, each of the connectors 52, 54 is operable to be connected to an external device, external wiring, and/or an external power source located outside of the first housing 12. In the exemplary embodiment, the female connector 52 is positioned through the end wall 22 and the male connector 54 is positioned through the end wall 20. However, it is foreseen that the connectors 52, 54 could be switched to extend through opposite ones of the end walls 20, 22 without deviating from the scope of the present inventive concept. It is further foreseen that the illumination system 10 could be configured with another male connector substituted for and in place of the female connector 52 or another female connector substituted for and in place of the male connector 54 based on a specific application's requirements without deviating from the scope of the present inventive concept.

The plurality of electrical components includes a driver 55 securely positioned on the rear wall 18 and entirely housed within the first housing 12. The driver 55 may be electrically coupled to one or both of the connectors 52, 54 via the wiring 50. The driver 55 is configured to regulate an amount of electrical power delivered to one or more light-emitting diodes associated with the illumination system 10. The driver 55 may regulate a DC voltage, a DC current, or both, supplied to the one or more light-emitting diodes. In some instances, the driver 55 is configured to receive an AC electrical power, e.g., a 120V AC electrical power. In other instances, the driver 55 is configured to receive a DC electrical power, e.g., a 12V DC electrical power. In certain variations, the driver 55 may be configured to allow a user to selectively dim the one or more light-emitting diodes. For example, and without limitation, the driver 55 may include a potentiometer to regulate a DC voltage supplied to the one or more light-emitting diodes. A state of the potentiometer may be selected via a dial or rotary switch, which is securely positioned on and through the cover 29, thereby allowing external access thereto and manipulation thereof by the user. Other configurations of the driver 55 for dimming capability, however, are possible. The plurality of electrical components further includes a power switch 56 operable to activate and deactivate the illumination system 10, and securely positioned on and through the cover 29, thereby allowing external access thereto and manipulation thereof by the user. The power switch 56 is electrically-coupled to the driver 55 to control electrical power received by the driver 55. The plurality of electrical components further includes a three-way switch 58 operable to variably control the illumination system 10, and securely positioned on and through the cover 29, thereby allowing external access thereto and manipulation thereof by the user. As described below, such variable control includes selectable activation of light-emitting diodes. The three-way switch 58 is electrically-coupled to the driver 55 such that the three-way switch 58 controls electrical power delivered to the one or more light-emitting diodes.

The second housing 30 includes a plurality of illumination strips, i.e., a first illumination strip 60 and a second illumination strip 62, which are entirely housed therein. It is foreseen, however, that the second housing 30 may house only a single illumination strip or additional illumination strips, e.g., three, four, or five illumination strips, without deviating from the scope of the present inventive concept. The illumination strips 60, 62 are identically sized and shaped, and extend parallel to each other on a printed circuit board 64, which is secured to the concave wall 32 within the second cavity 37 of the second housing 30 via a supporting base. The base is made of rigid material to provide structural support for the printed circuit board 64 and the illumination strips 60, 62. In the exemplary embodiment, the base is made of aluminum, but it is foreseen that the base may be made of any material with a similar degree of rigidity without deviating from the scope of the present inventive concept.

Each of the illumination strips 60, 62 include an equal number of light emitting diodes 66 so that each of the illumination strips 60, 62 is operable to emit visible radiation or light in a direction L. The light emitting diodes 66 are arranged in first and second rows along respective ones of the illumination strips 60, 62, with light emitting diodes 66 along each row spaced equidistant from each other. The plurality of light emitting diodes 66 are wired to the printed circuit board 64, which is wired to the switches 56, 58. In this manner, the plurality of light emitting diodes 66 is operable to be controlled by the switches 56, 58. The power switch 56 is a master control switch and is operable to simultaneously activate and/or deactivate the illumination system 10. The three-way switch 58 is operable to selectively and independently activate and/or deactivate each of the illumination strips 60, 62. For instance, the three-way switch 58 is operable to cause (i) the first row of light emitting diodes 66 on the illumination strip 60 to be activated and the second row of light emitting diodes on the illumination strip 62 to be deactivated, (ii) the first row of light emitting diodes on the illumination strip 60 to be deactivated and the second row of light emitting diodes on the illumination strip 62 to be activated, and (iii) the first row of light emitting diodes on the illumination strip 60 and the second row of light emitting diodes on the illumination strip 62 to be activated.

As further detailed in U.S. patent application Ser. No. 15/411,720, which is incorporated by reference herein in its entirety, the illumination strips 60, 62 respectively include a phosphor layer 70, 72. Each of the phosphor layers 70, 72 is made of a uniform composition that includes phosphor. The phosphor layers 70, 72 have different concentrations of phosphor relative to each other.

The illumination system 10 is manufactured by initially forming the first housing 12 with the walls 14, 16, 18, 20, 22, which define the first cavity 23, and the end walls 20, 22 including the arms 24, 26 respectively extending therefrom. The plurality of electrical components are securely mounted within and/or partially within the first cavity 23, e.g., exposed by the cover 29. The second housing is formed with the concave wall 32, which partially defines the second cavity 37. The elongated illumination strips 60, 62 are securely mounted within the second cavity 37 so that each of the illumination strips 60, 62 is (i) in communication with the plurality of electrical components, and (ii) operable to emit visible radiation or light in the direction L. The lens is securely mounted on the second housing 30 by securing the end caps 34, 36 to either end of the concave wall 32, which collaboratively define the second cavity 37. The second housing 30 is pivotably and/or rotatably secured to the first housing 12 via the arms 24, 26 to allow the visible radiation emitted from the illumination strips 60, 62 to be transmitted from the second housing 30 in the direction L, which can be selectively directed in one of a plurality of directions relative to the first housing 12 when the second housing 30 is pivoted or rotated relative to the first housing 12.

Figure 2:
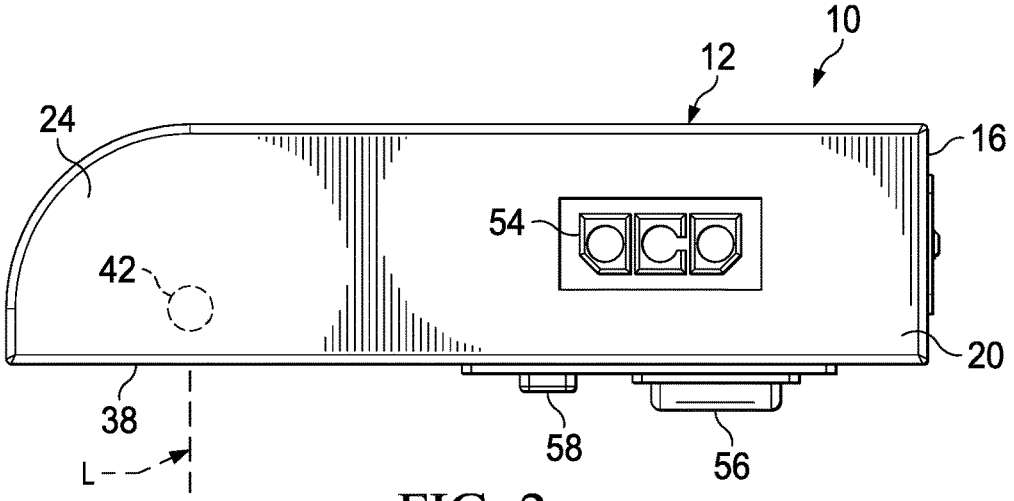
FIG. 2 illustrates an elevated left side view of the illumination system of the present inventive concept shown in FIG. 1 with the light emitting diode strip in the non-pivoted, planar configuration and the male electrical connector.
Figure 3:
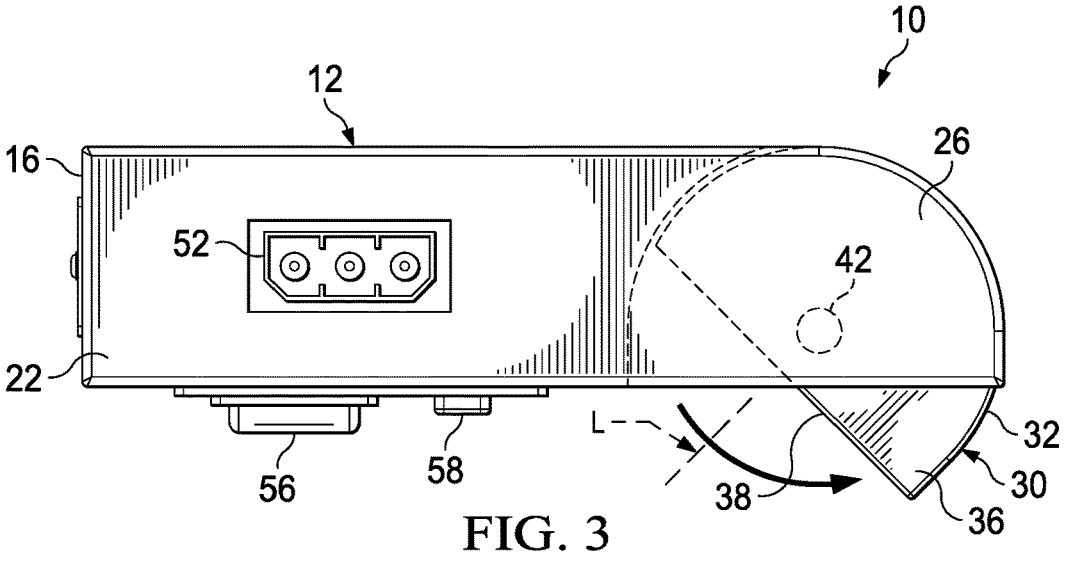
FIG. 3 illustrates an elevated right side view of the illumination system of the present inventive concept shown in FIG. 1 with the light emitting diode strip in a pivoted, non-planar configuration and a female electrical connector.
Figure 4:
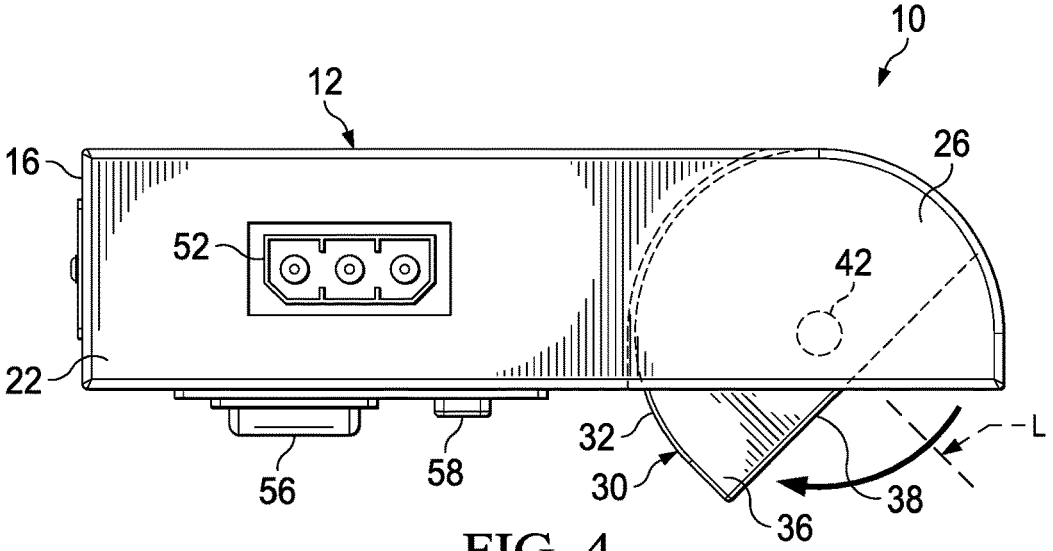
FIG. 4 illustrates an elevated right side view of the illumination system of the present inventive concept shown in FIG. 1 with the light emitting diode strip in another pivoted, non-planar configuration and the female electrical connector.
Figure 5:
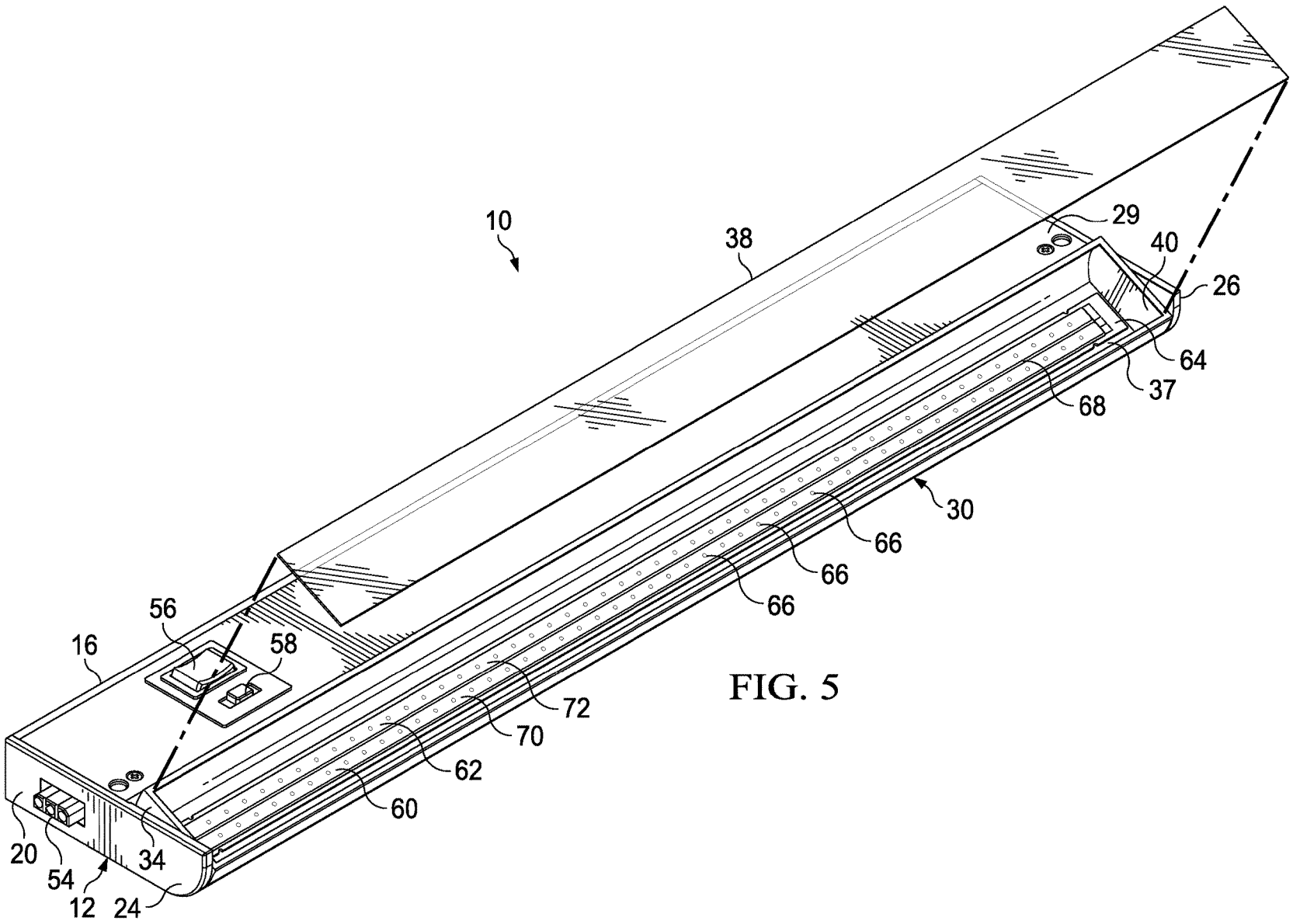
FIG. 5 illustrates an elevated left side view of the illumination system of the present inventive concept shown in FIG. 1 with a lens removed from a housing of the light emitting diode strip in the another pivoted, non-planar configuration.
Figure 6:
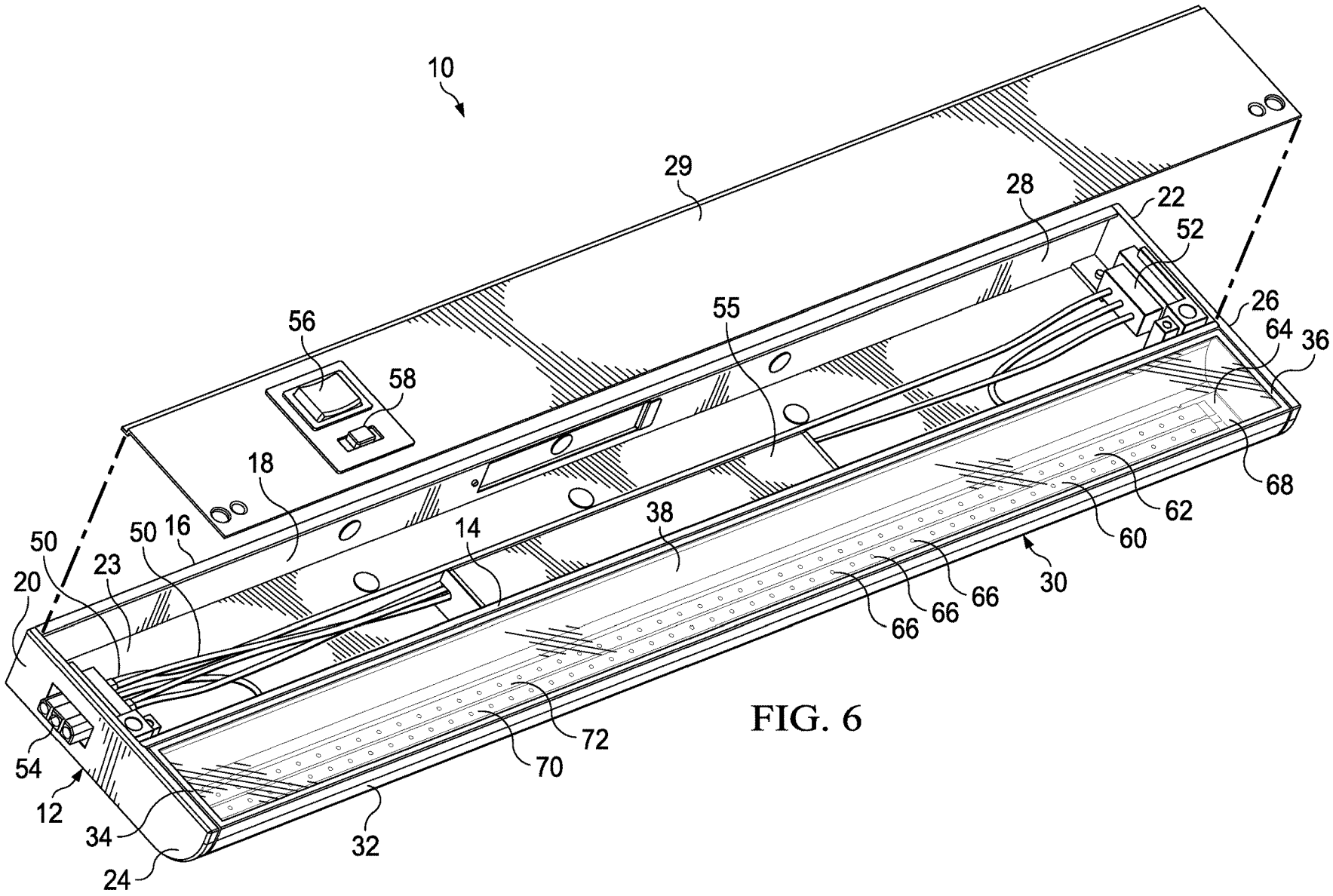
FIG. 6 illustrates an elevated left side view of the illumination system of the present inventive concept shown in FIG. 1 with a cover removed from a housing of electrical components in the non-pivoted, planar configuration.

The illumination system 10 is operable to be securely installed on the mounting surface, e.g., under a cabinet so that the illumination system 10 can be used as an under-cabinet light fixture that is operable to direct light downward from the cabinet and onto a countertop surface area. Additional instances or units of the illumination system 10, which are identical to the illumination system 10, may be installed on either side of the illumination system 10, e.g., in series with adjacent connectors 52, 54 connected together, thereby allowing expansion of the illumination system 10 to provide illumination to a larger area. In the exemplary embodiment, up to twenty independent units of the illumination system 10 may be linkable together for up to 200 watts. After installation of the illumination system 10, the user may alter the angle of light emission from the illumination system 10 by pivoting or rotating the second housing 30 relative to the first housing. For instance, if the user desires to illuminate a rear portion of the countertop surface area, the user may direct the light L emitted from the illumination system 10 toward a rear of the illumination system 10 by pivoting or rotating the second housing 30 to the configuration illustrated via FIG. 3. In this manner, the light L is emitted therefrom at a negative forty-five degree angle relative to an original configuration. For purposes herein, the "original configuration" of the illumination system 10 is an unadjusted, neutral or zero degree position of the second housing 30 relative to the first housing 12 as depicted by FIGS. 1 and 2, whereby (i) the light L is emitted at an angle that is perpendicular to a plane defined by the cover 29 mounted on the first housing 12, and (ii) the lens 38 extends along the same plane as the plane of the cover 29. Alternatively, if the user desires to illuminate a front portion of the countertop surface area, the user may direct the light L emitted from the illumination system 10 toward a front of the illumination system 10 by pivoting or rotating the second housing 30 to the configuration illustrated via FIG. 4. In this manner, the light L is emitted therefrom at a forty-five degree angle relative to the original configuration. In general, the second housing 30 may be rotatably or pivotably positioned to direct the light L anywhere at and between the range of negative forty-five degrees and forty-five degrees, i.e., within a ninety-degree range. As illustrated via FIG. 3, a portion of the first side wall 14 increasingly obstructs the light L when the second housing 30 is further rotated to direct light toward the first side wall 14. Thus, it is foreseen that a surface of the first side wall 14 may include a reflective material operable to redirect light incident thereon without deviating from the scope of the present inventive concept.

Having now described the features, discoveries, and principles of the present disclosure, the manner in which embodiment of the present disclosure are constructed and used, the characteristics of the construction, and advantageous, new and useful results obtained; the new and useful structures, devices, elements, arrangements, parts and combinations, are set forth in the appended claims.

The following claims are intended to cover all of the generic and specific features of the present disclosure herein described, and all statements of the scope of the present inventive concept, which, as a matter of language, might be said to fall there between.

What is claimed is:

1. An illumination system comprising:

a first housing (i) having a first side wall, a second side wall, and a pair of end walls extending between the first side wall and the second side wall, and (ii) defining a first cavity closed at least partially by a planar cover portion extending between the first side wall, the second side wall, and the end walls, each of the end walls extending beyond the first side wall and the planar cover portion to define one of two arm portions, the two arm portions defining a gap between the two arm portions, the gap having a perimeter defined at least in part by an outermost perimeter of the two arm portions;

at least one electrical component housed at least partially within the first cavity;

a second housing (i) pivotably secured to the two arm portions and at least partially within the gap, and (ii) defining a second cavity closed by a planer lens; and an elongated illumination strip (i) housed within the second cavity, (ii) in communication with the at least one electrical component, and (iii) operable to emit visible radiation in at least one direction, wherein, the second housing is operable to rotate relative to the first housing about an axis of rotation between a non-planer configuration and a planar configuration, the planar configuration is when the second housing is positioned with the planar cover portion extending parallel to the planar lens, the non-planer configuration is when the second housing is positioned with the planar cover portion extending nonparallel to the planar lens, the second housing includes end caps positioned partially within and partially beyond the perimeter of the gap when the second housing is positioned in the non-planar configuration, and the second housing includes a front surface portion that is exposed when the second housing is positioned in the planar configuration and remains exposed when the second housing is positioned in the non-planar configuration.

2. The illumination system of claim 1, wherein, the second housing includes a concave wall, the planar lens spans an opening defined by the concave wall and the end caps, and the planar lens is operable to allow the visible radiation emitted from the illumination strip to be transmitted from the second housing in the at least one direction.

3. The illumination system of claim 2, wherein, the first housing includes an access port defined by the first side wall, the second side wall, and the pair of end walls, and the access port is operable to be closed by a removable access panel.

4. The illumination system of claim 3, wherein, the opening defined by the concave wall and the end caps and the access port defined by the first side wall, the second side wall, and the pair of end walls are planar.

5. The illumination system of claim 2, wherein, the second housing is operable to allow a user to selectively direct light emitted from the light strip in one of a plurality of directions relative to the first housing by rotating the second housing about the axis of rotation.

6. The illumination system of claim 1, wherein, the at least one electrical component includes electrical wiring with (i) a female electrical connector extending through a first one of the sidewalls, and (ii) a male electrical connector extending through a second one of the sidewalls.

7. The illumination system of claim 1, wherein, the illumination strip includes (i) a first row of light emitting diodes positioned equidistant to each other along the illumination strip, and (ii) a second row of light emitting diodes positioned equidistant to each other along the illumination strip.

8. The illumination system of claim 7, further comprising:

a three-way switch operable to cause (i) the first row of light emitting diodes to be activated and the second row of light emitting diodes to be deactivated, (ii) the first row of light emitting diodes to be deactivated and the second row of light emitting diodes to be activated, and (iii) the first row of light emitting diodes and the second row of light emitting diodes to be activated.

9. The illumination system of claim 1, wherein, the illumination strip includes (i) a printed circuit board, (ii) a set of light emitting diodes positioned along the printed circuit board, and (iii) a phosphor layer extending along the printed circuit board and substantially encompassing the set of light emitting diodes.

10. The illumination system of claim 9, wherein, the illumination strip includes (i) another set of light emitting diodes positioned along the printed circuit board, and (ii) another phosphor layer extending along the printed circuit board and substantially encompassing the another set of light emitting diodes.

11. The illumination system of claim 10, wherein, the phosphor layer and the another phosphor layer have different concentrations of phosphor.

12. The illumination system of claim 1, wherein, each side of each of the end caps is selectively concealable and exposable by a respective one of the two arms when the second housing is rotated.

13. The illumination system of claim 1, wherein, the end caps are substantially concealed by the two arms when the second housing is positioned in the planar configuration.

14. The illumination system of claim 13, wherein, the end caps are partially concealed and partially exposed by the two arms when the second housing is positioned in the non-planar configuration.

15. A method of manufacturing an illumination system, the method comprising the steps of:

forming a first housing (i) having a first side wall, a second side wall, and a pair of end walls interconnecting the first side wall and the second side wall, and (ii) defining a first cavity closed at least partially by a planar cover portion extending between the first side wall, the second side wall, and the end walls, each of the end walls extending beyond the first side wall and the planar cover portion to define one of two arm portions, the two arm portions defining a gap between the two arm portions, the gap having a perimeter defined at least in part by an outermost perimeter of the two arm portions;

securing at least one electrical component at least partially within the first cavity;

rotatably securing a second housing to the two arm portions and at least partially within the gap, the second housing defining a second cavity closed by a planar lens; and securing an elongated illumination strip within the second cavity, the illumination strip (i) in communication with the at least one electrical component and (ii) operable to emit visible radiation in at least one direction, wherein, the second housing is operable to rotate relative to the first housing about an axis of rotation between a non-planar configuration and a planar configuration, the planar configuration is when the second housing is positioned with the planar cover portion extending parallel to the planar lens, the non-planar configuration is when the second housing is positioned with the planar cover portion extending nonparallel to the planar lens, the second housing includes end caps positioned partially within and partially beyond the perimeter of the gap when the second housing is positioned in the non-planar configuration, and the second housing includes a front surface portion that is exposed when the second housing is positioned in the planar configuration and remains exposed when the second housing is positioned in the non-planar configuration.

16. The method of claim 15, wherein, the second housing includes a concave wall, the planar lens spans an opening defined by the concave wall and the end caps, and the planar lens is operable to allow the visible radiation emitted from the illumination strip to be transmitted from the second housing in the at least one direction.

17. The method of claim 16, wherein, the second housing is operable to allow a user to selectively direct light emitted from the light strip in one of a plurality of directions relative to the first housing by rotating the second housing, about the axis of rotation, the end caps are substantially concealed by the two arms when the second housing is positioned in the planar configuration, and the end caps are partially concealed and partially exposed by the two arms when the second housing is positioned in the non-planar configuration.

18. The method of claim 15, wherein, the illumination strip includes (i) a first row of light emitting diodes positioned equidistant to each other along the illumination strip, and (ii) a second row of light emitting diodes positioned equidistant to each other along the illumination strip.

19. The method of claim 15, wherein, the illumination strip includes (i) a printed circuit board, (ii) a set of light emitting diodes positioned along the printed circuit board, and (iii) a phosphor layer extending along the printed circuit board and substantially encompassing the set of light emitting diodes.

20. The method of claim 19, wherein, the illumination strip includes (i) another set of light emitting diodes positioned along the printed circuit board, and (ii) another phosphor layer extending along the printed circuit board and substantially encompassing the another set of light emitting diodes, and the phosphor layer and the another phosphor layer have different concentrations of phosphor.

* * * * *